United States Patent [19]

Mourier

[11] 4,229,677

[45] Oct. 21, 1980

[54] HIGH-POWER HYPERFREQUENCY EMISSION TUBE

[75] Inventor: Georges Mourier, Paris, France

[73] Assignee: Thomson-CSF, Paris, France

[21] Appl. No.: 898,154

[22] Filed: Apr. 20, 1978

[30] Foreign Application Priority Data

Apr. 26, 1977 [FR] France ..... 77 12539

[51] Int. Cl.[2] ..... H01J 25/34

[52] U.S. Cl. ..... 315/3.6; 315/4; 315/5.41

[58] Field of Search ..... 315/3, 4, 5, 3.6, 5.41, 315/5.42

[56] References Cited

U.S. PATENT DOCUMENTS

| | | | |
|---|---|---|---|
| 2,726,291 | 12/1955 | Quate | 315/3.6 |
| 2,804,511 | 8/1957 | Kompfner | 315/3.6 X |
| 2,881,349 | 4/1959 | Eichenbaum et al. | 315/3.6 |
| 3,072,817 | 1/1963 | Gordon | 315/3 |
| 3,343,101 | 9/1967 | Haimson | 315/3.6 X |
| 3,463,959 | 8/1969 | Jory et al. | 315/5 |
| 3,576,460 | 4/1971 | Harman | 315/3.6 |
| 4,019,088 | 4/1977 | Budker et al. | 315/5 |

*Primary Examiner*—Saxfield Chatmon, Jr.
*Attorney, Agent, or Firm*—Roland Plottel

[57] ABSTRACT

A high power hyperfrequency emission tube which comprises, in a vacuum envelope:

means for generating and focussing an electron beam;

a plurality of energy collecting means;

a plurality of means for accelerating the electrons of the beam, formed by hyperfrequency circuits.

The collecting means and the accelerating means are distributed along the path of the electron beam and in its direction of propagation, with a spatial period $D_c$ and $D_a$ which is inherent in them, the accelerating means restoring to the electron beam the energy lost at the level of the collecting means.

11 Claims, 5 Drawing Figures

HIGH-POWER HYPERFREQUENCY EMISSION TUBE

This invention relates to a tube for emitting hyperfrequency electromagnetic waves of high power which may be used in particular in hyperfrequency power generators.

It is not possible by present techniques to construct generators delivering a high medium power at short wavelengths. Conventional hyperfrequency generators necessitate the use of circuits having very small dimensions because of the short wavelength of the hyperfrequency waves emitted. These circuits show high losses by Joule effect, this energy being more difficult to dissipate, the higher the mean power delivered.

Generators of the gyrotron type comprising a hyperfrequency circuit essentially formed by a wave guide of simple structure has been used with a view to obtaining high mean powers (cf. in particular the Article by A. V. Gaponov, A. L. Goldenberg, D. P. Grioriev and T. B. Pankratova in Izvestiya Vysshykh Uchebnykh Zavedenii Radiofizika SSSR, 1975, 18,2,280–289). However, the dimensions of these circuits remain of the order of the operating wavelength of the circuits and the problem of dissipation by Joule effect is still not satisfactorily solved, particularly for emissions of power of which the frequency is close to the upper limit of the hyperfrequency range. In addition, the operation of generators of this type requires the generation of magnetic fields of very high intensity of the order of 110,000 Gauss for a wavelength of 1 mm by the difficult and onerous use of superconducting materials.

The object of the present invention is to provide a hyperfrequency emission tube which does not have any of the limitations mentioned above.

The high-power hyperfrequency emission tube according to the invention, comprising in a vacuum envelope means for generating and focussing an electron beam, additionally comprises in the path of the electron beam and in the direction of propagation thereof a plurality of energy collecting means and means for accelerating the electrons of the beam, the energy collecting means and the accelerating means being uniformly distributed over the path of the electron beam in accordance with a certain spatial period which is inherent in them and the accelerating means being formed by hyperfrequency circuits which restore to the electron beam the energy dissipated at the level of the collecting means.

In another variant of the invention, a uniform movement is given to the electron beam along a closed path having an axis of symmetry.

By means of the emission tube according to the invention, it is possible to obtain a mean power proportional to the number of collecting and accelerating means which it comprises and hence to the size of the tube along the path of the electron beam.

The output of a hyperfrequency tube according to the invention is higher, the greater the size of the tube along the path of the electron beam and the greater the power of the electron beam.

Emission tubes of this type may be used in generators for treating materials, in heating generators for the plasmas of machines of the slow thermonuclear fusion type or of the magnetic confinement type, or in installations for transferring energy over long distances, such as telecommunications installations where they act as "pumping" elements for the parametric emission amplifiers.

Other features of the invention will become apparent from the following description and the accompanying drawings, wherein.

Figure 1:
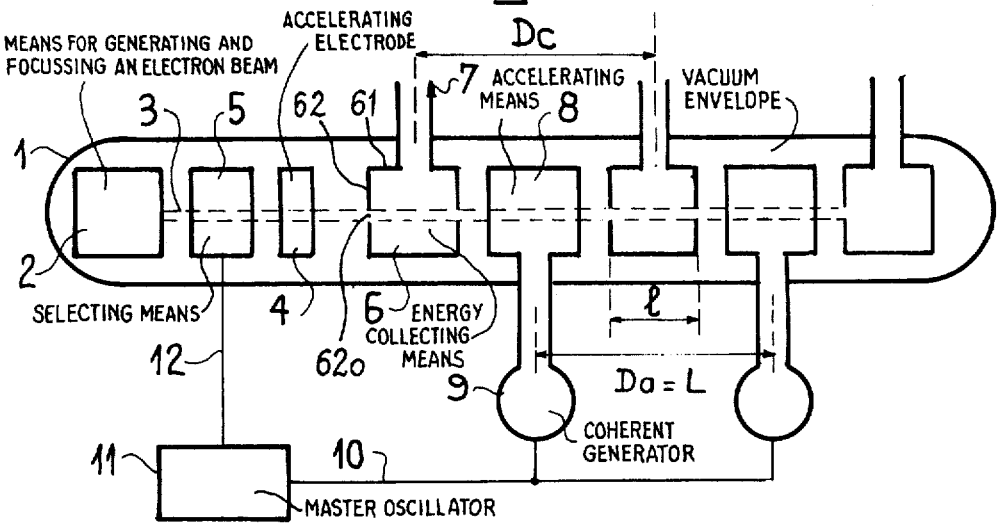
FIG. 1 shows an emission tube according to the invention.

In FIG. 1, the hyperfrequency emission tube according to the invention comprises, in a vacuum envelope 1, means for generating and focussing an electron beam 3. The means 2 for generating the electron beam comprise for example an electron gun and focussing electrodes (not shown in FIG. 1). An electrode 4 enables the electrons of the beam to be accelerated. The electrode 4 is formed for example by a perforated anode which, in operation, is brought to a positive voltage relative to the cathode of the electron gun. In the path of the electron beam 3, the emission tube comprises a plurality of energy-collecting means 6 and means 8 for accelerating the electrons of the electron beam. The energy-collecting means and the means for accelerating the electrons of the beam are uniformly distributed over the path of the electron beam in accordance with a spatial period Dc in the case of the collecting means and Da in the case of the accelerating means which is inherent in them. The spatial period Da of the accelerating means may for example be taken equal to a whole multiple k of spatial periods Dc of the collecting means, i.e. $L=Da=kDc$. In one particular embodiment of the invention, the spatial periods Da and Dc of the accelerating means and the collecting means are identical, the collecting means and the accelerating means thus forming an alternate arrangement in the path of the electron beam. The collecting means 6 are formed by any circuit of the hyperfrequency type which enables the useful energy to be extracted from the beam of electrons in the form of a very high frequency signal.

The circuits of the hyperfrequency type referred to above are, for example, resonant cavities tuned to the frequency F of the very high frequency signal excited by the electron beam at the level of the resonant cavity. As shown in FIG. 1, these cavities consist of sections 61 of a cylindrical guide which are closed at each end by a disc 62 formed at its centre with a hole 620 for the passage of the electron beam. The hyperfrequency circuit may also be formed by a delay line comprising an input, to which a hyperfrequency signal of frequency F for modulating the beam is applied in operation, and an output 7 which, in every case, represents the output delivering the useful energy in the form of a useful hyperfrequency signal of frequency F.

The accelerating means 8 may be formed for example by accelerating electrodes similar to the electrode 4 and brought to d.c. acceleration potentials. In order to avoid the problems involved in insulating the electrodes mentioned above, the accelerating means 8 are formed in one preferred embodiment by circuits of very high frequency, particularly hyperfrequency circuits, which restore to the electron beam the energy dissipated at the level of the collecting means. In operation, the hyperfrequency circuits forming the accelerating means 8 are fed by hyperfrequency signals having a frequency f very much lower than the frequency of the useful signal of frequency F. The accelerating means are connected for example to coherent generators 9 excited by a master oscillator 11 through a common circuit 10.

In one preferred embodiment of the invention, the emission tube additionally comprises, in the path of the electron beam and up-stream of the first of the collecting means in the direction of propagation of the beam, means 5 for selecting the electrons of said beam to enable the electron beam to be cut, as will be explained in more detail hereinafter. The selecting means 5 are preferably arranged between the means 2 for generating the electron beam 3 and the accelerating electrode 4, the beam thus being cut when the electrons have a low kinetic energy.

Figure 2:
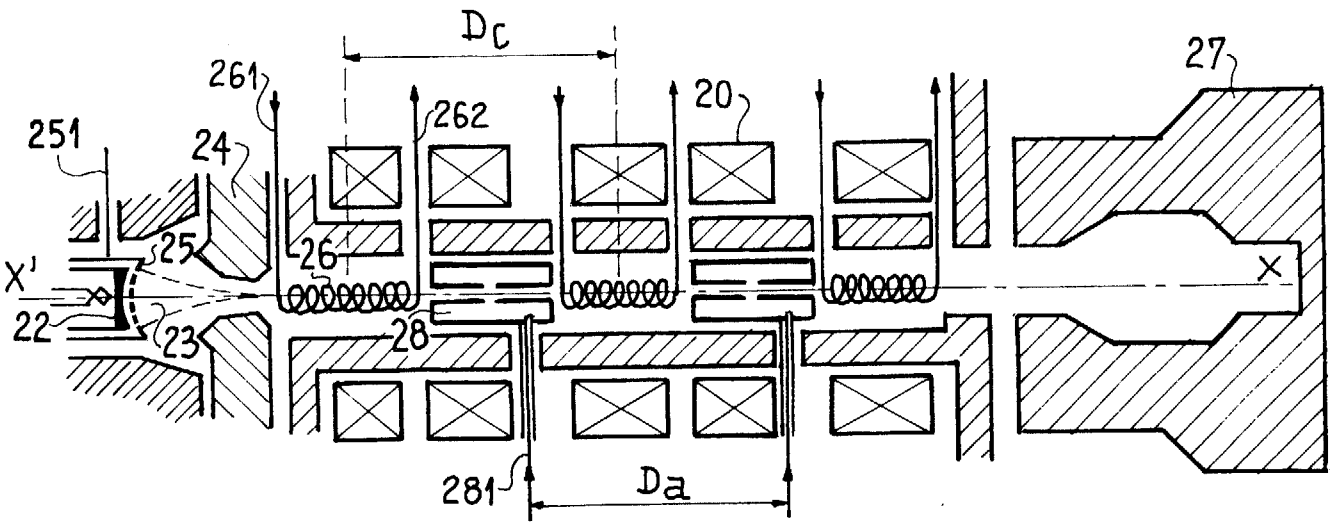
FIG. 2 is a longitudinal section through an emission tube according to the invention.

FIG. 2 is a longitudinal section through one particular embodiment of the emission tube according to the invention. In FIG. 2, in which the vacuum envelope has not been shown, the tube comprises at one of its ends an electron gun formed by a concave emissive cathode 22 and a control grid 25 comprising a connecting electrode 251. The control grid 25 is intended to perform the function of the above-mentioned selecting means 5 when the tube is in operation. A perforated anode 24, to which a positive biassing voltage relative to the emissive cathode is applied in operation, enables the electrons of the electron beam having a longitudinal axis X'X and represented by the dash-dot lines 23 to be suitably accelerated in operation. A collector 27 or target provided with cooling fins at the opposite end of the tube enables the electrons to be recovered. Permanent magnets 20 or coils are distributed along the path of the electron beam to focus the electron beam over its entire path. A series of resonators or, for example, delay lines formed by spirals 26 are disposed in the path of the electron beam. The delay lines 26 are spaced apart by a distance Dc and perform the function of the above-mentioned collecting means. The delay lines 26 comprise an input terminal 261 excited by a very high frequency electromagnetic signal of frequency F and an output terminal or output antenna 262 at which the useful energy of very high frequency is recovered. A resonant cavity 28 is interposed between two consecutive delay lines 26. The spiral delay lines 26 are the most suitable for the conventional hyperfrequency range. In the case of a frequency F amounting to several hundred gigaherz, the helical delay lines are preferably replaced by finned lines. Irrespective of the resonators used, the emission tube described above operates as follows: the electron beam entering the first of the collecting means 6 gives off some of its kinetic energy in the form of a hyperfrequency wave of frequency F excited at the level of the constituent hyperfrequency circuits of the collecting means 6. This energy is delivered to the level of the output 7 of the above-mentioned hyperfrequency circuits. The electrons are grouped into bunches at the frequency F from the first of the collecting means 6.

The first of the accelerating means 8 encountered by the electrons of the electron beam in their path restores to the electrons the kinetic energy which they lost in the first of the collecting means and the following means. The acceleration imparted to the electrons of the beam 3 is obtained by way of the signals of frequency f which feed the accelerating means 8 in operation. By repeating the pattern, i.e. accelerating means followed by one or more collecting means, it is possible to recover a useful signal of frequency F at the output 7 of each collecting means. The signals supplied by the various outputs 7 of the collecting means 6 may be recombined in phase in a wave guide or an antenna, providing these signals have well-defined phase relations (cf. in particular French Patent Application No. 75 39 527 filed in applicants' name). Thus, repetition of the pattern—accelerating means 8 followed by one or more collecting means 6—has to verify the following relation in regard to the number N of collecting means comprised between two accelerating means 8 and the spatial period $Da = kDc$ of the accelerating means.

For the signals at frequency f, the propagation of the electrons permits the definition, for the signals of frequency f, of a corresponding transit angle $\phi$ such as exists between two consecutive accelerators $$\Omega/ve\ N\ Dc = \phi \qquad \text{(I)}$$

$\Omega = 2\pi f$ being the pulsation of the signals feeding the accelerating means 8 and ve the mean velocity of the electrons of the beam. The bunches of electrons which pass through the first accelerating circuit 8 are thus restored to the same conditions in all the successive accelerators if the phase of the signals of frequency f differs by $\phi$ between two successive accelerators.

With regard to the interaction between the electron beam and the collecting means 6 for collecting means of length l along the path of the electron beam, the angle $\theta$ of interaction between the electron beam 3 and the useful hyperfrequency signal of pulsation $\omega = 2\pi F$ is expressed as follows:

$$\theta = \omega l/ve \qquad \text{(II)}$$

where ve is the velocity of the electrons. An effective interaction of the electron beam and the signal of frequency F is obtained for values of $\theta$ equal to several tens of radians.

The ratio of the pulsations of the signals feeding the accelerating means and the useful signals is expressed as follows:

$$\frac{\Omega}{\omega} = \frac{\phi}{\theta}\ \frac{1}{NDc}$$

The excitation of the generating tube by the signals of frequency f is effected under conditions which are better, the lower this frequency f in relation to the frequency F of the useful signals. Thus, for an interaction angle $\theta = 20\pi$, for a transit angle $\phi = 2\pi$ and a length $Dc = 10$ l, the ratio $\Omega/\omega = 1/300$ for a number $N = 3$ of collector circuits comprised between two consecutive accelerators, i.e. also for $k = 3$, provides for the use of a generating tube for which the useful signal has a frequency of 300 GHz for a frequency f of the excitation signal which is a sub-multiple of the signal of frequency F and equal to 1 GHz.

In cases where the phase velocity of the high frequency wave corresponds to an inverse wave, the input and output connections 261 and 262 of the excitation signal at frequency F and of the useful signal are inverted at the level of the delay lines, an attenuation impedance being connected to the terminals 262 of the lines other than the first delay line in the direction of propagation of the electrons.

Figure 3:
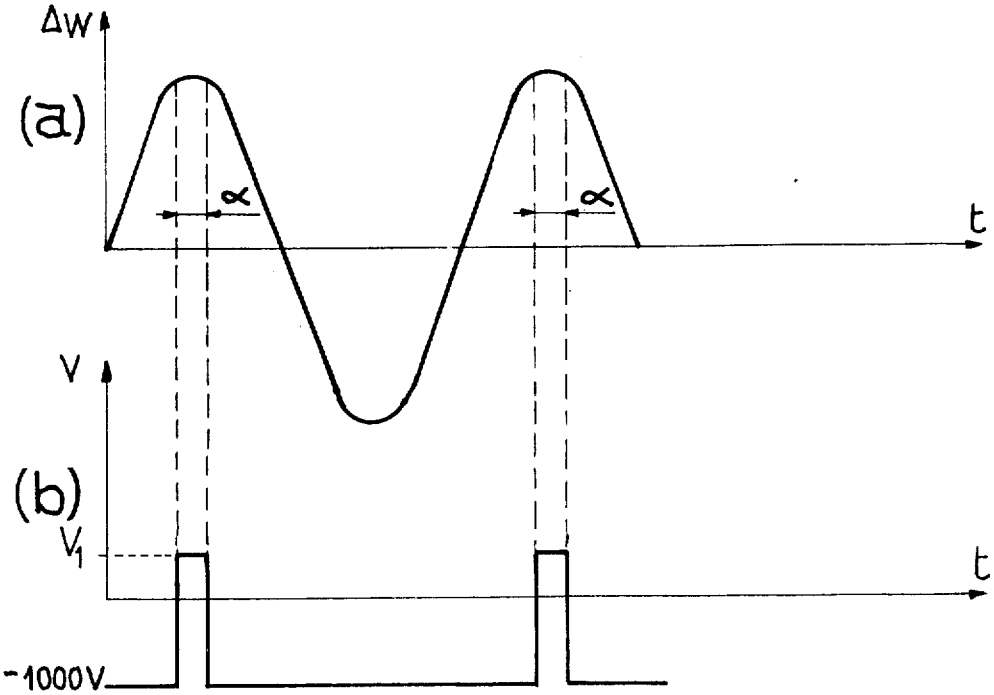
FIG. 3 shows wave forms of the control signals applied to the tube in operation and the distribution curve as a function of time of the energy given off to the electron beam by the accelerating means.

FIG. 3 shows the variation $\Delta\omega$ in the energy given off by each of the accelerating means when they are fed by the signal of frequency f. The energy given off at the level of each of the means to each electron passing through them shows a sinusoidal variation as a function of time. This energy is accelerating in a half period of the signal of frequency f for which $\Delta\omega$ is positive. This energy can only be considered as constant for the phases corresponding to an interval $\alpha$ corresponding to the maximum energy given off, such as shown in FIG. 3. To obtain an acceleration of the electrons of the electron beam during the angle or interval $\alpha$, the electron beam is chopped into sections of length a such that:

$$\omega a/ve = \alpha$$

This effect is obtained by the selecting means 5 to which are applied in operation a highly negative voltage of the order of $-1000$ V outside the energy exchange maximums corresponding to the intervals $\alpha$ and a positive voltage $V_1$ very much lower in value than the accelerating voltage applied to the accelerating electrode 4. The corresponding wave form is delivered by the master oscillator 11 and the conductor 12 to the selecting means 5 formed for example by a loose-mesh grid. It is this which justifies the presence of the means 5 and the master oscillator 11 which, in one simple embodiment, consists of a pulse generator simultaneously feeding the accelerating means 8.

In cases where the collecting means operate in accordance with the principle of progressive-wave cubes, the energy-producing phase is stable and the deceleration of the fastest electrons tends to compensate the variation in the exchanged energy $\Delta\omega$ during the phase variation $\alpha$. In addition, it is of advantage to use a relativistic electron beam, i.e. a beam of which the electrons have a velocity of propagation close to that of light, for which the variations in energy correspond to small variations in velocity and provide for better retention of the phase relations.

In one particular embodiment, the effect of variation in the exchanged energy $\Delta\omega$ is compensated by the use as excitation signal of a composite signal formed by one or more additional components which are harmonics of the frequency f. Thus, the use of an excitation signal having the form $f2=4/3$ ($\cos \Omega t=\frac{1}{4} \cos 2\Omega t$) provides for a reduction in the variation of the exchanged energy $\Delta\omega$ for a phase variation $\alpha$ comprised between $\pm 18°$ between the values 1 and 0.9984, i.e. for a variation in the exchanged energy of 2 to 3 per thousand. The preceding embodiment is particularly interesting in cases where the frequency f is low enough to allow the easy intervention of harmonics.

The efficiency of the generating tube according to the invention is defined as the ratio $$\rho = \frac{\rho_{cc}\,\rho_a}{1 + \frac{Vo}{V1}\,\rho\,\frac{a}{Nc}}$$

of the power available at the frequency F to the power supplied by the feed sources, i.e. the power of the beam plus the power of the accelerating means, where:

- $\rho$ cc is the circuit efficiency of the collecting means,
- $\rho$ a is the global acceleration efficiency, taking into account the efficiency of the generating means and the efficiency of the accelerating means,
- Nc is the number of collecting means which the generating tube comprises,
- Vo is the voltage for accelerating the electrons of the beam due to the means 4,
- V1 is the energy in electron volts which each electron is capable of giving off in each collecting section.

For a large number Nc of collecting circuits, the efficiency $\rho$ increases with that number and tends towards the product of the circuit efficiency of the collecting means and of the efficiency of the accelerating means.

It will be noted that, for a beam without any loss of intensity Io, all the power of the accelerating means is re-encountered in the collecting means: this power is Nc V1 Io/$\rho$ a when $\rho$ a is the efficiency of the accelerating means.

Figure 4:
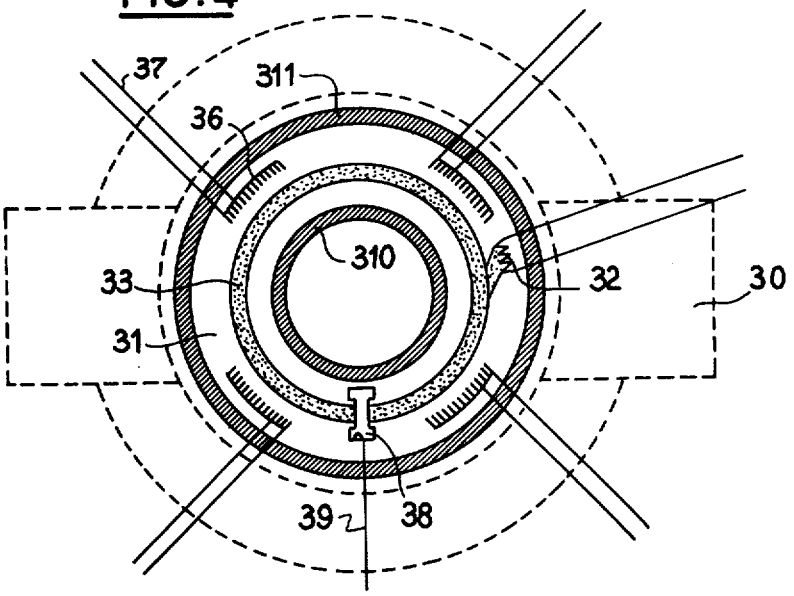
FIGS. 4 and 5 are cross-sections through an emission tube corresponding to a variant of the invention.
Figure 5:
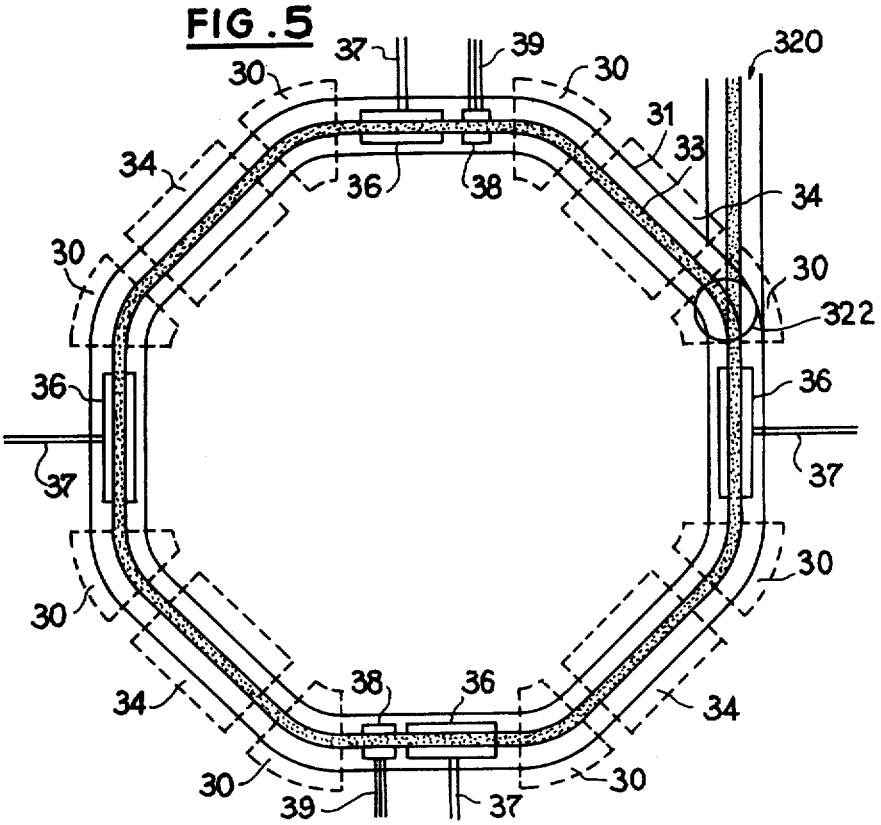

FIGS. 4 and 5 are diagrammatic cross-sections through two particular embodiments of an emission tube according to one variant of the invention. In this variant, the electron beam has a closed trajectory with an axis. Accordingly, the beam continues indefinitely to pass through the accelerating zones and the collecting zones for as long as it is kept in orbit. The period in question may be considerable, of the order of several hours, when the losses of electrons on the walls of the envelope, in which the movement of the beam takes place, are reduced by focussing means.

This movement around a closed trajectory may be obtained by any means known in the art, for example as in a betatron by the action of a magnetic field variable as a function of time. The electrical field induced accelerates the electrons supplied by a cathode accommodated in the vacuum envelope of the installation in a circular orbit (cf. in particular: D. W. KERST "The Acceleration of Electrons by Magnetic Induction" in Phys. Rev. Volume 60 (1941), page 47, and M. S. LIVINGSTON and J. P. BLEWETT "Particle Accelerators", Chapter 7, Mc. GRAW HILL, 1962). However, once this acceleration has been acquired in the tubes according to the invention operating in the steady state, the electrons are maintained in a uniform movement around their orbit, as in a storage ring. It is with this uniform movement that they complete their repeated passages through the accelerators and the collecting cavities. The uniform movement is obtained by keeping the variable magnetic field of the initial acceleration phase constant as a function of time. Accordingly, the tube according to the invention has all the constituent elements of a betatron with characteristics adapted to its particular operating conditions, as will become apparent hereinafter.

In another version of the same variant, acceleration of the electrons from the source is obtained outside their final trajectory, after which the beam is injected into that trajectory on which it is maintained in a uniform movement by a fixed magnetic field. Accordingly, the tube takes part of its structure from the storage rings referred to above.

It is known that an injection such as this necessitates a certain number of measures to enable the beam to enter the zone of the fixed magnetic field. The problem of this injection has a certain number of solutions which are known in the art of accelerators and which it is not intended to discuss here.

FIGS. 4 and 5 show two versions of the tube corresponding to these two cases.

In FIG. 4, the electron beam is produced from a cathode 32 in an annular vacuum chamber 31 defined by the walls 310 and 311. It is subjected to an axial magnetic field which is directed perpendicularly to the plane of the figure and of which the contour of the lines of force in that plane has not been shown. This field, which is variable as a function of time, is itself produced by the magnetic circuit 30 consisting of pole pieces and exciting coils under conditions which are well known in the betatron art (cf. the Articles quoted above).

The electrons of the beam describe circular trajectories around the axis of the field. In this plane, the trajectories are comprised within the area covered by dots and denoted by the reference 33. They are then kept in a uniform movement on these trajectories by a constant magnetic field running in the same direction.

The reference 36 denotes the high-frequency energy collectors placed in the vicinity of and outside the trajectory of the electrons, whilst the reference 37 denotes the guide by which the high frequency energy is extracted from these collectors which, in the example illustrated, are diagrammatically illustrated as comb-shaped delay lines. The Figure shows by way of example an accelerator 38 which is intended to restore to the beam the energy given off to the resonators 36. This energy is injected into the accelerator by the coupling element 39 from a source (not shown). The accelerators used, such as 38, are for example resonant cavities of re-entrant profile which are traversed by the beam in their central part, as shown in the drawing, and of which the resonance frequencies are much lower than those of the preceding delay lines under the conditions soon explained. Several accelerators, such as 38, may be provided at various points of the path followed by the electrons in the tube.

The cathode 32 is of small dimensions and is not subjected to the same conditions as the cathodes of the previously described variants of the invention (in particular convergence), but instead to the known conditions of betatron installations to which corresponds an elaborate optical system known from the prior art and of which no elements have been shown for that reason.

The efficiency of the embodiments described above depends upon the energy to be used for the initial acceleration of the beam, upon the efficiency of the interaction of the beam and the high frequency energy collectors, upon the efficiency of the accelerator circuits responsible for restoring the energy level of the electrons and, above all, upon the residence time of the electrons in their orbit which will be made as long as possible.

The first of these conditions is of no importance in the case of long-term operations, i.e. for which precisely this residence time is long. The efficiency of the accelerator circuits is known from all the existing accelerators, particularly linear accelerators; that of the interaction between the beam and the collectors, which decreases with the operating wavelength, does not involve any problems which are specific to the tubes according to the invention. In the present case, the corresponding frequency is very high.

With regard to the question of the residence time of the beam on its orbit, FIG. 5 shows how it is possible to utilise the provisions known from the prior art (cf. in particular "L'utilisation du rayonnement synchrotron en France"-Annales de Physique 9-1975) for increasing this residence time at the expense of an increase in the diameter of the machine.

In FIG. 5, the same elements as in the preceding figure have been denoted by the same reference numerals.

In contrast to the case illustrated in the preceding Figure, however, the beam is produced in another part of the tube which could be for example a betatron, as in the preceding case. In one preferred version of this variant, which is shown by way of example in FIG. 5, this part could also be a linear accelerator 320 of which only the terminal part is shown in the Figure. The electron beam is injected at one point of the envelope 31 placed in an axial magnetic field of fixed direction and invariable as a function of time, under the action of which the electrons describe a uniform movement around the closed trajectories comprised in the section of the Figure in the ring covered by dots and denoted by the reference 33. As in the preceding case, this Figure is a diagrammatic section taken along a plane perpendicular to the magnetic field (not shown).

The movement of the electrons in the vacuum envelope 31 is the same as that of the beam of a storage ring. The axial magnetic field performs a guiding function. As already mentioned, particular measures have to be taken to enable the electrons to be extracted from the accelerator and to be injected into the envelope 31. These measures are put into effect by the injector 322, as known in the art.

In addition, the trajectories of the electrons are in this case polygonal. This form is obtained by focussers 34 which create an auxiliary magnetic field intended to focus the beam on its orbit and to avoid the losses of electrons on the envelope 31. They consist of coils connected to current sources.

The magnetic circuit 30 which produces the magnetic field is in this case divided into four pairs of portion which are all denoted by the reference 30 and which are arranged on four of the sides of the octagon of the figure, each pair surrounding one of the focussers 34. A collector 36 is disposed on each of the other four sides of the octagon alternating with the four sides previously mentioned; two of them also carry an accelerator 38. It is thus possible to extend the operating time over a period which varies with the installations and which may reach several hours.

The frequency of the high-frequency wave extracted at these collectors 36 is a multiple of the resonance frequency of the accelerators 38. For the expression of the multiplication factor, reference is made to what was previously stated. In every case, the output power collected at the collectors is modulated to the frequency of the accelerations received by the beam. This frequency, which depends upon the number of accelerators 38, is selected in dependence upon the application contemplated.

A collection of numerical values is given by way of example in the following for a tube corresponding to this variant of the invention. In a uniform magnetic field of 0.113 teslas, an electron having a kinetic energy of 4.6 MeV follows a circular orbit 30 cm in diameter with a frequency of rotation of 316 MHz; in addition, the conditions prevailing at this level (4.6 MeV) are relativistic: the linear velocity of an electron exceeds 0.99 c. The collecting cavities 36 are wave guide sections 20 mm long in which an electrical field of 10 KV/mm is present in operation. Under these conditions, one electron loses 200 keV during its passage through a collector of the type in question. With a 1 milliamp electron beam, therefore, a power of 100 watts is collected at the terminals of each collector. With four collectors, as in the example of FIG. 5, this corresponds to a total power of four times that value. All these powers are in phase, i.e. coherent, by virtue of the high velocity of the beam, and it is easy to add them. This power is obtained at the frequency of 100 GHz. This frequency is particularly stable due to the fact that the beam remains on its orbit for a prolonged period and rotates under substantially fixed phase conditions when, as in the example mentioned, its speed is sufficient (0.99 c) for the dissipation of energy to take place without any change in velocity. Accordingly, tubes with a high power output at millimetric wavelengths and high frequency stability are obtained.

In addition, the figures quoted above show that, in the phase where the tube operates as a betatron, i.e. in the initial acceleration phase of the version shown in FIG. 4, the operating conditions are very clearly within the extreme conditions of the betatron. By virtue of the low value of the magnetic field, it is possible to use an iron-free magnetic circuit, i.e. a magnetic circuit limited to the exciting coils, and to obtain greater regularity of the magnetic field in the installation.

What is claimed is:

1. A tube for emitting high power electromagnetic waves which comprises, in a vacuum envelope:

means for generating and focussing an electron beam;

a plurality of energy collecting means formed by circuits of the hyperfrequency type which modulate the electron beam and extract the useful energy in the form of a signal of very high frequency F;

a plurality of means for accelerating the electrons of the beam formed by hyperfrequency circuits comprising a resonant cavity with an input to which is applied in operation an hyperfrequency signal of frequency f such that $f/F=\Omega/\omega=\phi/\theta\cdot 1/ND_c$, where:

$\Omega=2\pi f$;

$\omega=2\pi F$;

$\phi$ is the transit angle existing between two consecutive accelerating means;

$\theta$ is the interaction angle existing between the electron beam and the useful signal of frequency F;

$D_c$ is the spatial period of the collecting means uniformly distributed with the accelerating means, of spatial period $D_a$, along the path of the electron beam and in its direction of propagation;

N is the number of collecting means comprised between two accelerating means;

the spatial period $D_a$ of the accelerating means being equal to a whole multiple k of the spatial period $D_c$ of the collecting means and the accelerating means restoring to the electron beam the energy lost at the level of the collecting means.

2. A tube as recited in claim 1, wherein the accelerating means and the collecting means have identical spatial periods Da and $D_c$ and form an alternating arrangement along the path of the electron beam.

3. A tube as recited in claim 1, wherein the hyperfrequency circuits modulating the electron beam are formed by a spiral delay line comprising an input, to which a hyperfrequency signal modulating the beam of frequency F is applied in operation, and an output which delivers the useful energy in the form of a hyperfrequency signal of the same frequency.

4. A tube as recited in claim 1, wherein the hyperfrequency circuits modulating the electron beam are formed by a resonant cavity which is in turn formed by sections of a cylindrical guide closed at each end by a disc formed with a hole at its centre for the passage of the electron beam.

5. A tube as recited in claim 1, which comprises means for imparting to the electrons of the beam a uniform movement along a closed trajectory having an axis.

6. A tube as recited in claim 5, wherein the means for imparting a uniform movement to the beam consist of means for producing a magnetic field variable as a function of time which, in a first phase, accelerate the electrons on orbits situated in a plane perpendicular to said axis, and consist of means for subsequently maintaining the electrons in a uniform movement on those orbits by the application of a fixed magnetic field directed along said axis.

7. A tube as recited in claim 5, wherein the means for imparting a uniform movement to the beam consist of means for producing a fixed magnetic field directed along that axis, of means for accelerating the beam on an orbit in a plane perpendicular to said axis and of means for injecting the beam into this field at a velocity perpendicular to said axis.

8. A tube as recited in claim 5, which comprises means for focusing the electrons of the beam on their trajectory.

9. A tube as recited in claim 1 which comprises, in the path of electron beam and up-stream of the first of the collecting means in the direction of propagation of the beam, means for selecting the electrons of said beam to enable the electron beam to be chopped into sections of length a such that $\chi\cdot a/V_e=\alpha$, where $\alpha$ is the angle during which the energy given off by each of the accelerating means is maximum and can be considered as constant as a function of time and where $V_e$ is the velocity of the electrons.

10. A tube as recited in claim 9, wherein the selecting means comprise a control electrode which, in operation, is brought to a periodic potential equal in frequency to the frequency of the hyperfrequency signal of frequency f.

11. A tube as recited in claim 1, wherein the electron beam is a beam of which the electrons have a progagation velocity close to that of light.

* * * * *